US009156276B2

(12) United States Patent
De Meutter et al.

(10) Patent No.: US 9,156,276 B2
(45) Date of Patent: Oct. 13, 2015

(54) METHODS FOR INKJET VARNISHING

(71) Applicant: Agfa Graphics NV, Mortsel (BE)

(72) Inventors: Stefaan De Meutter, Mortsel (BE); Geert Van Dyck, Mortsel (BE); David Tilemans, Mortsel (BE)

(73) Assignee: Agfa Graphics NV, Mortsel (BE)

( * ) Notice: Subject to any disclaimer, the term of this patent is extended or adjusted under 35 U.S.C. 154(b) by 0 days.

(21) Appl. No.: 14/404,654

(22) PCT Filed: Jun. 17, 2013

(86) PCT No.: PCT/EP2013/062496

§ 371 (c)(1),
(2) Date: Dec. 1, 2014

(87) PCT Pub. No.: WO2014/005826

PCT Pub. Date: Jan. 9, 2014

(65) Prior Publication Data

US 2015/0116425 A1 Apr. 30, 2015

Related U.S. Application Data

(60) Provisional application No. 61/673,260, filed on Jul. 19, 2012.

(30) Foreign Application Priority Data

Jul. 6, 2012 (EP) ..... 12175235

(51) Int. Cl.

| | |
|---|---|
| ***B41J 2/015*** | (2006.01) |
| ***B41J 2/21*** | (2006.01) |
| ***B41M 7/02*** | (2006.01) |
| ***B41J 11/00*** | (2006.01) |
| *B41M 7/00* | (2006.01) |
| *B41L 23/24* | (2006.01) |

(52) U.S. Cl.

CPC ..... *B41J 2/2114* (2013.01); *B41J 11/002* (2013.01); *B41M 7/02* (2013.01); *B41L 23/24* (2013.01); *B41M 7/0045* (2013.01); *B41M 7/0054* (2013.01); *B41M 7/0081* (2013.01)

(58) Field of Classification Search

CPC .... B41J 2/2114; B41J 11/002; B41M 7/0045; B41M 7/0054; B41M 7/0081; B41L 23/25

USPC ..... 347/21

See application file for complete search history.

(56) References Cited

U.S. PATENT DOCUMENTS

| | | | | |
|---|---|---|---|---|
| 9,016,847 | B1 * | 4/2015 | Iijima et al. | 347/100 |
| 2006/0021535 | A1 | 2/2006 | Kaiser | |

(Continued)

FOREIGN PATENT DOCUMENTS

| | | | |
|---|---|---|---|
| EP | 1 930 169 | A1 | 6/2008 |
| EP | 2 228 230 | A1 | 9/2010 |
| GB | 2 423 520 | A | 8/2006 |

OTHER PUBLICATIONS

Official Communication issued in International Patent Application No. PCT/EP2013/062496, mailed on Jul. 9, 2013.

*Primary Examiner* — Jannelle M Lebron
*Assistant Examiner* — Jeremy Bishop
(74) *Attorney, Agent, or Firm* — Keating & Bennett, LLP

(57) ABSTRACT

A method for inkjet varnishing a substrate includes the steps of jetting a micro-pattern of a varnish having a viscosity of less than 30 mPa·s at 45° C. and at a shear rate of 30 $s^{-1}$ to a portion of the substrate by one or more printheads having nozzles with a nozzle diameter of no more than 30 μm, and at least partially curing the micro-pattern within 500 milliseconds after jetting to provide a micro-roughness to the portion of the substrate.

15 Claims, 1 Drawing Sheet

(56) References Cited

U.S. PATENT DOCUMENTS

| | | | | |
|---|---|---|---|---|
| 2006/0198964 | A1 | 9/2006 | Kaiser | |
| 2006/0230965 | A1 | 10/2006 | Thal | |
| 2010/0166975 | A1 | 7/2010 | Abergel | |
| 2010/0194837 | A1 | 8/2010 | Ohshima et al. | |
| 2015/0035905 | A1* | 2/2015 | De Meutter et al. | 347/47 |

* cited by examiner

METHODS FOR INKJET VARNISHING

CROSS-REFERENCE TO RELATED APPLICATIONS

This application is a 371 National Stage Application of PCT/EP2013/062496, filed Jun. 17, 2013. This application claims the benefit of U.S. Provisional Application No. 61/673,260, filed Jul. 19, 2012, which is incorporated by reference herein in its entirety. In addition, this application claims the benefit of European Application No. 12175235.6, filed Jul. 6, 2012, which is also incorporated by reference herein in its entirety.

BACKGROUND OF THE INVENTION

1. Field of the Invention

The present invention relates to methods for applying a varnish by inkjet printing to a substrate, e.g. to a printed image.

2. Description of the Related Art

A varnish is a transparent liquid applied to a surface for producing a glossy appearance. A varnish may also be designed to produce satin or semi-gloss sheens by the addition of "flatting" agents. These flatting agents, also often called matting agents, are particulate substances for scattering incident light rays on the varnished surface. The matting agent particles stand out from the varnish layer, invisible to the human eye. This requires the matting agent particles to have an average particle size of several microns to tens of microns. Such large particle sizes make reliable inkjet printing of a mat varnish impossible since the nozzles of an inkjet printhead generally have a nozzle diameter of about 30 μm or less. The major advantage of inkjet printing is that it allows variable data printing.

US 2006230965 (HEIDELBERGER DRUCKMASCHINEN) discloses an offset printing method wherein a transparent glossy varnish is coated on the entire printed surface of a print using a varnishing unit. In addition a mat varnish containing a high content of silicate matting agent can also be applied if a mat finish is desired. Even if large particle size of matting agents in a varnish would be feasible by inkjet, the use of two varnishes, a glossy and a mat varnish, for controlling the gloss of a print would make an inkjet printer more complex and expensive.

US 2010166975 (MGI) discloses in claims 12 and 13 an inkjet ink including an additive with a granulometry less than 50 μm, wherein the additive includes a flatting agent for obtaining a mat or satin varnish, and/or, flakes for obtaining a flaked varnish, and wherein the inkjet ink has a granulometry suited for passing through a nozzle when ink is deposited by an ink-jet on a printed substrate. There is no practical example disclosed of a mat varnish. However flatting agents having a particle size up to 50 μm implicitly require nozzles diameters in the inkjet print head for reliable inkjet printing being much larger than 50 μm, thereby also drastically reducing the print resolution of the mat varnish and the capability of controlling the gloss of a specific part of a printed image.

US 2006021535 (HEIDELBERGER DRUCKMASCHINEN) discloses a method for radiation curable printing and aftertreating a print, wherein the aftertreatment involves adjusting the level of gloss of the print by applying to the print particles matting the surface of the ink. The particles having a diameter of more than 5 μm are applied using a powdering device having powder nozzles.

Problems with gloss homogenity may be observed when the printing speed increases, such as e.g. in single pass inkjet printing. EP 1930169 A (AGFA GRAPHICS) discloses a UV-curable inkjet printing method using a first set of printing passes during which partial curing takes place, followed by a second set of passes during which no partial curing takes place for improving the gloss homogeneity.

Another method to produce a stripe-free, smooth and highly glossy surface is by using a fast flowing UV varnish. US 2006198964 (HEIDELBERGER DRUCKMASCHINEN) discloses a method for inkjet varnishing of a print, which comprises ejecting varnish drops by an inkjet printer onto a surface of the print, wherein the varnish drops are ejected in a screen pattern. In this way, the required amount of varnish is smaller than when a varnish layer is applied over the complete surface of the print. The screen may be an FM- or an AM-screen. This allows preventing disturbing line structures. Depending on the flow characteristics of the varnish that is applied, a glossy or a matt result may be obtained. To obtain a high gloss level, a UV varnish that has a low viscosity, and that thus flows easily, is used, while a UV varnish that has a high viscosity is used to obtain a matte surface. However, again two varnishes are required for controlling the gloss, including a varnish of higher viscosity which limits the printing speed. In industrial ink jet systems, there is a constant demand for increased printing speeds in combination with high image quality. The new print heads, designed for increasing printing speed, only operate with very low viscous inkjet inks and varnishes.

EP 2228230 A (XEROX) discloses a method of controlling gloss of an image through micro-patterning a radiation curable ink and/or overcoat, i.e. a varnish, by non-uniformly curing the ink and/or overcoat followed by flood curing. The non-uniformly curing of the ink and/or overcoat is achieved by applying radiation through a mesh mask, or by laser curing by means of rastering a continuous wave or pulsed laser. Including such curing means makes the inkjet printer more complex and expensive. The micro-pattern is imparted to the radiation curable ink and/or overcoat by providing micro-roughness to one or more portions of the radiation curable ink and/or overcoat. At least one gellant must be present in the overcoat which results in a solid-like overcoat composition that below 50° C. has a viscosity of about $10^3$ to $10^7$ mPa·s. This not only increases the energy consumption of the inkjet printer but also put some limitations on the type of substrates that can be printed upon due to their thermal sensitivity.

US 2010/0194837 A1 (RICOH) discloses an image recording method includes ejecting an ink to form an image on the surface of a recording layer of a recording medium; and then applying a glossiness imparting liquid on the surface of the recording medium.

GB 2423520 A (SUN CHEMICAL) discloses a sprayable energy-curable coating composition comprising an epoxide monomer or oligomer, a cationic photoinitiator, and a cyclic carbonate, wherein the cyclic carbonate is present in an amount of at least 7 wt. % based on the composition. The sprayable energy-curable coating composition is used as a varnisch formulation;

Micro-roughness refers to surfaces marked by irregularities and/or protuberances imperceptible to normal and unaided human sight and touch, which surfaces are capable of diffuse reflection of light.

Micro-patterning refers to an irregular (e.g. random) or regular patterning of one or more surfaces characterized by micro-roughness.

There is still a need for an improved method of inkjet varnishing a print which is capable of controlling the gloss of a print by using a single varnish of low viscosity that can be printed at high resolution, speed and reliability without the need of any flatting agents.

SUMMARY OF THE INVENTION

In order to overcome the problems described above, preferred embodiments of the present invention provide a method for inkjet varnishing a substrate as described below.

It was surprisingly found, and this contrary to a widely held technical prejudice, as exemplified by US 2006198964 (HEIDELBERGER DRUCKMASCHINEN) and EP 1930169 A (AGFA GRAPHICS), that a single varnish of low viscosity could not only be used to improve the gloss of a substrate but also to reduce the gloss without the need of any flatting agents, if a micro-pattern of the varnish was jetted and rapidly cured after jetting the varnish thereby introducing micro-roughness to the substrate. The low viscosity varnish allowed also for printing at high resolution, speed and reliability.

Further objects of the invention will become apparent from the description hereinafter.

DETAILED DESCRIPTION OF THE PREFERRED EMBODIMENTS

Definitions

Figure 1:
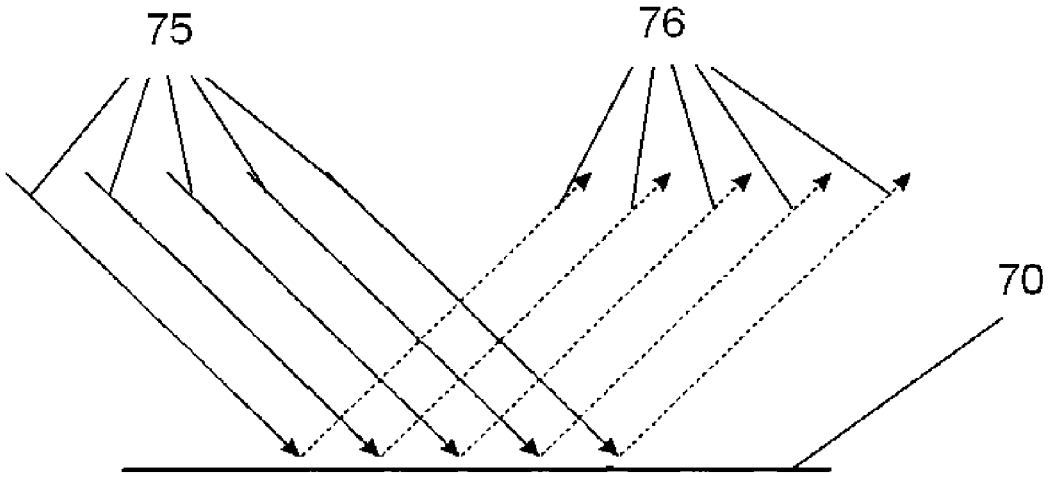
FIG. 1 illustrates specular reflection from a smooth surface of a substrate 70. Incident light rays 75 are reflected in substantially the same manner as visualized by reflected light rays 76, thus leading to a glossy appearance of the substrate 70.
Figure 2:
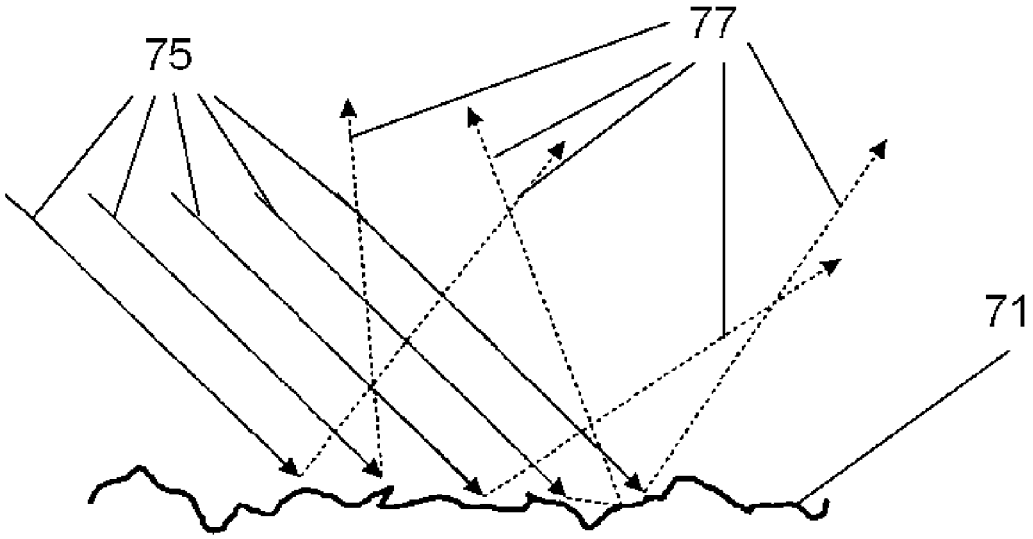
FIG. 2 illustrates diffuse reflection from a surface having micro-roughness 71. Incident light rays 75 are reflected in a substantially different manner as visualized by reflected light rays 77, thus leading to a mat appearance of the substrate 71.

The term "print" means a finished, printed image on a substrate that is made using all the image data that make up the image. The image may contain pictures, text, or any other object that may be printed.

The term "radiation curable ink" means that the ink is curable by devices for "radiation curing", which are in this document UV radiation or e-beam.

The term "alkyl" means all variants possible for each number of carbon atoms in the alkyl group i.e. methyl, ethyl, for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl, etc.

Unless otherwise specified a substituted or unsubstituted alkyl group is preferably a $C_1$ to $C_6$-alkyl group.

Unless otherwise specified a substituted or unsubstituted alkenyl group is preferably a $C_1$ to $C_6$-alkenyl group.

Unless otherwise specified a substituted or unsubstituted alkynyl group is preferably a $C_1$ to $C_6$-alkynyl group.

Unless otherwise specified a substituted or unsubstituted aralkyl group is preferably a phenyl or naphthyl group including one, two, three or more $C_1$ to $C_6$-alkyl groups.

Unless otherwise specified a substituted or unsubstituted alkaryl group is preferably a $C_1$ to $C_6$-alkyl group including a phenyl group or naphthyl group.

Unless otherwise specified a substituted or unsubstituted aryl group is preferably a phenyl group or naphthyl group Unless otherwise specified a substituted or unsubstituted heteroaryl group is preferably a five- or six-membered ring substituted by one, two or three oxygen atoms, nitrogen atoms, sulphur atoms, selenium atoms or combinations thereof.

The term "substituted", in e.g. substituted alkyl group means that the alkyl group may be substituted by other atoms than the atoms normally present in such a group, i.e. carbon and hydrogen. For example, a substituted alkyl group may include a halogen atom or a thiol group. An unsubstituted alkyl group contains only carbon and hydrogen atoms Unless otherwise specified a substituted alkyl group, a substituted alkenyl group, a substituted alkynyl group, a substituted aralkyl group, a substituted alkaryl group, a substituted aryl and a substituted heteroaryl group are preferably substituted by one or more substituents selected from the group consisting of methyl, ethyl, n-propyl, isopropyl, n-butyl, isobutyl and tertiary-butyl, ester, amide, ether, thioether, ketone, aldehyde, sulfoxide, sulfone, sulfonate ester, sulphonamide, —Cl, —Br, —I, —OH, —SH, —CN and $—NO_2$.

Substrates

The substrate is the base material where the varnish is inkjet printed upon, and can be a substantially flat object, such as a billboard or a door, or can be a three dimensional object, such as a vase.

A glossy or mat varnish can be applied to a three dimensional object by spray coating, but contrary to inkjet printing a lot of material is spilled during the process.

There is no real limitation of the substrate used in the inkjet varnishing methods in accordance with the invention, and it includes common ink-receivers such as paper and film, (food) packaging materials, metal or glass materials and the like.

In a preferred embodiment, the substrate is a print. A print is a finished, printed image that is made using all the image data that make up the image. The image may contain pictures, text, or any other object that may be printed. The print may be made by any known technique, including offset, flexography, electrography and inkjet, but is preferably made by radiation curable inkjet printing, more preferably UV curable inkjet printing. Radiation curable inkjet printing allows for printing on substantially non-absorbing substrates.

A print or substrate has a particular "coverage" by ink or varnish drops; e.g. a coverage of 40% by ink, means that a fraction of the surface of the print (or of the surface of the substrate) is covered by the concerned ink. At a coverage of 100%, the surface is maximally covered by the concerned ink. A print may have e.g. a coverage of 40% black ink and 100% yellow ink. In ink-jet printing, the exact fraction of the surface that is covered also depends on the spreading of the ink on the surface of the ink-receiver; in case of high spreading, a larger fraction of the surface will be covered. For example, in customary single pass inkjet printer configurations, a maximal coverage of 100% of a specific ink such as black ink, will be obtained by firing all nozzles for black ink, while a coverage of 40% of black ink will be obtained by firing 40% of the black ink nozzles.

Inkjet Varnishing Methods

The method for inkjet varnishing a substrate according to a first aspect of the present invention includes the steps of a) jetting a micro-pattern of a varnish having a viscosity of less than 30 mPa·s at 45° C. and at a shear rate of 30 $s^{-1}$ to a portion of said substrate by one or more printheads having nozzles with a nozzle diameter of no more than 30 μm; and b) at least partially curing the micro-pattern within 500 milliseconds after jetting, thereby providing a micro-roughness to said portion of said substrate.

A varnish having a very low viscosity of less than 30 mPa·s at 45° C. and at a shear rate of 30 $s^{-1}$ allows for fast inkjet printing by using one or more printheads having nozzles with small nozzle diameters.

The printheads having nozzles with a nozzle diameter of no more than 30 μm, preferably no more than 25 μm, more preferably no more than 22 μm and most preferably no more than 20 μm. A small nozzle diameter allows for a small drop size of the varnish and thus high resolution inkjet printing. The drop size is preferably no more than 6 pL, more preferably no more than 4 pL. For small drop sizes, preferably a high image resolution such as 1200×1200 dpi is used.

The varnish is at least applied to a portion of the substrate, but the portion of the substrate may of course, in some embodiments, be the complete substrate, especially in the case of a print.

The curing of the micro-pattern of varnish is performed within 500 milliseconds after jetting the varnish, more preferably within 250 milliseconds after jetting the varnish, and most preferably within 150 milliseconds after jetting the varnish. The fast curing prevents the rapid spreading of varnish drops of small drop size on a substrate in high resolution inkjet printing.

In one embodiment, the micro-pattern includes a plurality of varnish drops having a first drop size and a plurality of varnish drops having a second drop size larger than said first drop size. Preferably the varnish has three, four or more different drop sizes. Such technique is known as grey scale inkjet printing, wherein several droplets are ejected by a print head and combined during their flight to a single larger drop.

In another embodiment, the micro-pattern is jetted by one or more binary or grey scale inkjet print heads using a single size of ink drop.

In a preferred embodiment, the micro-pattern has a coverage of 40% to 80% of said portion of said print, more preferably a coverage of 50% to 70% of said portion of said print. At such coverage of varnish, there are minimal differences in gloss on a print having a broadly differing ink coverage.

The print is preferably printed by inkjet printing of one or more radiation curable inkjet inks. The image data for printing the one or more radiation curable inkjet inks is then preferably used to determine a location for the micro-pattern of the varnish. For example, in one embodiment the micro-pattern is preferably jetted on those areas having the highest ink coverage, i.e. the micro pattern is jetted on a portion of said print having the highest amount of radiation curable inkjet ink per unit of surface area.

The image data can be used to obtain a same gloss level throughout the whole level, for example, a fully mat picture. However, the image data can also be used to have different gloss appearances in the image, e.g. a glossy, shiny sports car on a mat background for advertisement reasons.

In a preferred embodiment, the micro-pattern of the varnish is cured by uniform radiation curing.

In a preferred embodiment, the varnish is jetted using one or more high-resolution inkjet print heads having a nozzle diameter of no more than 30 μm, preferably no more than 25 μm or 20 μm. This allows for achieving a micro-pattern inducing efficiently a micro-roughness to a small portion of said print. Moreover, nozzle diameters larger than 30 μm result in high graininess.

According to another aspect of the invention, the invention provides in one embodiment a varnished substrate, e.g. a varnished print material obtained by a method in accordance with the first aspect of the invention.

Varnishes

The varnish is preferably a colourless, clear radiation curable liquid, more preferably a free radical curable liquid. The addition of large size particulate matter, like a flatting or matting agent, to varnish generally leads to a translucent or even opaque cured layer in stead of the desired transparent layer. A transparent cured varnish layer allows good viewing or inspection of e.g. a print beneath the varnish layer.

In a preferred embodiment, the varnish contains no or less than 0.1 wt % of particulate matter based on the total weight of the varnish that has an average size larger than 10% of the nozzle diameter as measured by laser diffraction. In a more preferred embodiment, the varnish contains no particulate matter based on the total weight of the varnish that has an average size larger than 10% of the nozzle diameter as measured by laser diffraction. In a very preferred embodiment, the varnish contains no particulate matter at all.

The particulate matter can have different shapes, such as a globular or a needle shape. While particulate matter having a needle shape and a size equal or larger to the nozzle diameter may still glide through the nozzle and allow the full functioning of a print head, globular particulate matter having a diameter equal or larger to the nozzle diameter will block a nozzle in a print head from firing. Such a failing nozzle leads to undesired gloss differences and image artefacts. Hence, the varnish preferably includes no particulate matter having a size larger than the nozzle diameter of the one or more printheads, more preferably the varnish includes no particulate matter having a size larger than 70% of the nozzle diameter of the one or more printheads, and most preferably the varnish includes no particulate matter having a size larger than 50% of the nozzle diameter of the one or more printheads.

In another embodiment, the varnish may include particulate matter of small size. A yellowish varnish or a varnish which turns yellow on radiation curing can be advantageously used to give a substrate, such as a print, a antique look. An antique look is commercially desirable e.g. for giving a piece of furniture an antique look or for making a photograph or a print look aged.

In one embodiment, the varnish includes a yellow colour pigment having an average particle size of less than 200 nm as determined by laser diffraction. Such small average particle size not only allows for printing with print heads having nozzle diameters of 30 μm or less, but also for keeping the varnish transparent so that colours below the varnish can still be clearly seen. If a yellow colour pigment is used in the varnish, a polymeric dispersant similar to those disclosed for the radiation curable inkjet inks here below is preferably used. Suitable yellow pigments include those disclosed below for the radiation curable inkjet inks.

In another embodiment, the varnish includes a photoyellowing photoinitiator, preferably a thioxanthone photoinitiator. Such a photoinitiator generally has a strong photoyellowing effect but also allows for fast curing within 500 milliseconds, e.g. by UV LEDs.

In yet another embodiment, a combination of both a photoyellowing photoinitiator and a yellow colour pigment having an average particle size of less than 200 nm as determined by laser diffraction may be sued.

The static surface tension of the varnish is preferably from 20 to 40 mN/m, more preferably from 22 to 35 mN/m. It is preferably not more than 40 mN/m from the viewpoint of the wettability. The static surface tension is preferably measured with a KRÜSS tensiometer K9 from KRÜSS GmbH, Germany at 25° C. after 60 seconds.

The varnish preferably also contains at least one surfactant so that the dynamic surface tension is no more than 30 mN/m measured by maximum bubble pressure tensiometry at a surface age of 50 ms and at 25° C. The dynamic surface tension is measured using a Bubble Pressure Tensiometer BP2 available from KRÜSS. The varnish is placed in a thermostatic vessel of the tensiometer at a temperature of 25° C. A silanized, glass capillary with a capillary radius 0.22 mm was immersed to a depth of 10 mm in the varnish. The dynamic surface tension is measured as a function of surface age using e.g. Labdesk software and using air as the gas for creating the bubbles.

In a preferred embodiment, the dynamic surface tension of the ink is less than or equal to the dynamic surface tension of the varnish.

For having a good ejecting ability and fast inkjet printing, the viscosity of the varnish at the temperature of 45° C. is preferably smaller than 30 mPa·s, more preferably smaller than 15 mPa·s, and most preferably between 1 and 10 mPa·s all at a shear rate of 30 s−1. A preferred jetting temperature is between 10 and 70° C., more preferably between 25 and 50° C., and most preferably between 35 and 45° C.

The varnish may include the same ingredients as those disclosed for the radiation curable inkjet inks here below. Although, with the exception of a yellowish varnish, the varnish preferably does not include a colourant.

Inkjet Inks

The inkjet inks used in a preferred embodiment of the method of the present invention are preferably radiation curable inkjet inks, more preferably free radical curable inkjet inks.

The static surface tension of the inkjet ink is preferably from 20 to 40 mN/m, more preferably from 22 to 35 mN/m. It is preferably 20 mN/m or more from the viewpoint of printability by a second radiation curable inkjet ink, and it is preferably not more than 30 mN/m from the viewpoint of the wettability.

The inkjet ink preferably also contains at least one surfactant so that the dynamic surface tension is no more than 30 mN/m measured by maximum bubble pressure tensiometry at a surface age of 50 ms and at 25° C.

For having a good ejecting ability and fast inkjet printing, the viscosity of the inkjet ink at the temperature of 45° C. is preferably smaller than 30 mPa·s, more preferably smaller than 15 mPa·s, and most preferably between 1 and 10 mPa·s all at a shear rate of 30 s−1. A preferred jetting temperature is between 10 and 70° C., more preferably between 25 and 50° C., and most preferably between 35 and 45° C.

Vinylether Acrylate Monomers

The radiation curable varnish and/or inkjet ink preferably include a vinylether(meth)acrylate monomer. Vinylether acrylate monomers allow preparing radiation curable compositions of extremely low viscosity.

The vinylether(meth)acrylate monomer is preferably a monomer represented by Formula (VA-I):

Formula (VA-I)

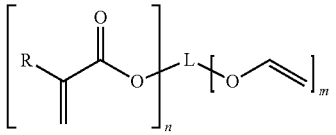

wherein,

R represents hydrogen or a methyl group;

L represents a linking group comprising at least one carbon atom; and n and m independently represent a value from 1 to 5.

The radiation curable varnish and/or inkjet ink preferably includes 2-(2-vinyloxyethoxy)ethyl acrylate as vinylether (meth)acrylate monomer.

In a preferred embodiment, the vinylether(meth)acrylate monomer is present in the radiation curable varnish and/or inkjet ink in an amount of 20 wt % to 90 wt %, more preferably 25 wt % to 80 wt % and most preferably 30 wt % to 70 wt %, all based upon the total weight of the radiation curable varnish or inkjet ink.

Other Polymerizable Compounds

The radiation curable varnish and inkjet inks preferably include a free radical polymerizable compound. Cationically polymerizable compounds can also be used but generally have a slower curing speed. For realizing a micro-pattern of a varnish inducing micro-roughness to a print in less than 500 milliseconds, the curing speed of radical polymerizable compounds is advantageously used.

A combination of monomers, oligomers and/or prepolymers may also be used and they may possess different degrees of functionality. A mixture including combinations of mono-, di-, tri- and higher functionality monomers, oligomers and/or prepolymers may be used. The viscosity of the inkjet ink and varnish can be adjusted by varying the ratio between the monomers and oligomers. Particularly preferred monomers and oligomers are those listed in [0106] to [0115] of EP 1911814 A (AGFA).

For achieving high printing speeds, low viscous monomers are used so that a low viscosity for the radiation curable inkjet ink and varnish can be obtained. A popular low viscosity monomer is tetrahydrofurfuryl(meth)acrylate. However, in industrial inkjet printing also a high reliability is required which allows the incorporation of the inkjet printing system into a production line.

It was found that a vessel of tetrahydrofurfuryl acrylate kept at 40° C. for 100 hours lost 40% of its weight. Printing heads in the present method preferably operate at temperatures between 35 to 45° C. A high evaporation of tetrahydrofurfuryl(meth)acrylate from a print head nozzle during a stand-by mode from the inkjet printer leads to an unacceptable increase in viscosity of the inkjet ink in the print head and subsequently to jetting failures of the print head (bad latency). The varnish and radiation curable inkjet inks preferably use low viscosity monomers exhibiting small evaporation rates such as vinyl ether(meth)acrylates. For example, 2-(2-vinyloxyethoxy)ethyl acrylate (VEEA) kept at 40° C. for 100 hours loses only 8% of its weight.

In a preferred embodiment, the monomers in the radiation curable inkjet ink which have a viscosity of less than 15 mPa·s at 45° C. and at a shear rate of 30 s−1, lose less than 15% of their weight when kept at 40° C. for 100 hours in an open cubic vessel.

Another advantage of VEEA is that it is a bifunctional monomer having two different polymerizable groups, namely an acrylate group and an ether group. This allows a better control of the polymerization rate, whereby the amount of extractable and migrateable monomer is reduced. This reduces health risks to inkjet printer operators or allows for printing e.g. food packaging materials that are subject to strict safety regulations.

In a preferred embodiment, the radiation curable inkjet ink or varnish includes a monomer including at least one acrylate group and at least one ethylenically unsaturated polymerizable group selected from the group consisting of allylether group, allylester group, allylcarbonate group, vinyl ether group, vinylester group, vinylcarbonate group, fumarate group, and maleate group. Suitable examples are disclosed in EP 2053101 A (AGFA).

In a preferred embodiment, the polymerizable composition of the radiation curable inkjet ink and/or varnish consists essentially of: a) 25-100 wt % of one or more polymerizable compounds A having at least one acrylate group and at least one second ethylenically unsaturated polymerizable functional group selected from the group consisting of a vinyl ether group, an allylether group and an allylester group; b) 0-55 wt % of one or more polymerizable compounds B selected from the group consisting of monofunctional acrylates and difunctional acrylates; and c) 0-55 wt % of one or more polymerizable compounds C selected from the group consisting of trifunctional acrylates, tetrafunctional acrylates, pentafunctional acrylates and hexafunctional acrylates, with the proviso that if the weight percentage of compounds B>24 wt %, then the weight percentage of compounds C>1 wt %; and wherein all weight percentages of A, B and C are based upon the total weight of the polymerizable composition; and with the proviso that at least one polymerizable compound B or C is present in the polymerizable composition if the free radical curable inkjet ink contains no initiator. Such a composition allows for safe inkjet printing on food packaging materials.

The monomers and oligomers used in radiation curable inkjet inks are preferably purified compounds having no or almost no impurities, more particularly no carcinogenic, mutagenic or reprotoxic impurities. The impurities are usually derivative compounds obtained during synthesis of the polymerizable compound. Sometimes, however, some compounds may be added deliberately to pure polymerizable compounds in harmless amounts, for example, polymerization inhibitors or stabilizers.

The radiation curable inkjet ink and varnish preferably includes 60 to 95 wt % of polymerizable compounds, more preferably 70 to 90 wt % of polymerizable compounds based upon the total weight of the radiation curable inkjet ink or varnish. A varnish may include up to 99 wt % of polymerizable compounds based upon the total weight of the radiation curable varnish.

Colourants

The radiation curable inkjet ink can be a clear radiation curable inkjet ink, but preferably it includes at least one colourant. The colourant is preferably a dye or a pigment, most preferably a pigment.

The pigments may be black, white, cyan, magenta, yellow, red, orange, violet, blue, green, brown, mixtures thereof, and the like. A colour pigment may be chosen from those disclosed by HERBST, Willy, et al. Industrial Organic Pigments, Production, Properties, Applications. 3rd edition. Wiley-VCH, 2004. ISBN 3527305769.

Preferred pigments are disclosed in paragraphs [0128] to [0138] of WO 2008/074548 (AGFA).

Preferred pigments include as red or magenta pigments, Pigment Red 3, 5, 19, 22, 31, 38, 43, 48:1, 48:2, 48:3, 48:4, 48:5, 49:1, 53:1, 57:1, 57:2, 58:4, 63:1, 81, 81:1, 81:2, 81:3, 81:4, 88, 104, 108, 112, 122, 123, 144, 146, 149, 166, 168, 169, 170, 177, 178, 179, 184, 185, 208, 216, 226, 257, Pigment Violet 3, 19, 23, 29, 30, 37, 50, 88, Pigment Orange 13, 16, 20, 36, as blue or cyanogen pigments, Pigment Blue 1, 15, 15:1, 15:2, 15:3, 15:4, 15:6, 16, 17-1, 22, 27, 28, 29, 36, 60, as green pigments, Pigment Green 7, 26, 36, 50, as yellow pigments, Pigment Yellow 1, 3, 12, 13, 14, 17, 34, 35, 37, 55, 74, 81, 83, 93, 94, 95, 97, 108, 109, 110, 137, 138, 139, 153, 154, 155, 157, 166, 167, 168, 180, 185, 193, as black pigments, Pigment Black 7, 28, 26, as white pigments, Pigment White 6, 18 and 21.

Also mixed crystals may be used. Mixed crystals are also referred to as solid solutions. For example, under certain conditions different quinacridones mix with each other to form solid solutions, which are quite different from both physical mixtures of the compounds and from the compounds themselves. In a solid solution, the molecules of the components enter into the same crystal lattice, usually, but not always, that of one of the components. The x-ray diffraction pattern of the resulting crystalline solid is characteristic of that solid and can be clearly differentiated from the pattern of a physical mixture of the same components in the same proportion. In such physical mixtures, the x-ray pattern of each of the components can be distinguished, and the disappearance of many of these lines is one of the criteria of the formation of solid solutions. A commercially available example is Cinquasia™ Magenta RT-355-D from Ciba Specialty Chemicals.

Also mixtures of pigments may be used. For example, the radiation curable inkjet ink includes a black pigment and at least one pigment selected from the group consisting of a blue pigment, a cyan pigment, magenta pigment and a red pigment. It was found that such a black inkjet ink was better readable and scannable on a transparent polypropylene infusion bag.

Pigment particles in inkjet inks should be sufficiently small to permit free flow of the ink through the inkjet-printing device, especially at the ejecting nozzles. It is also desirable to use small particles for maximum colour strength and to slow down sedimentation.

The numeric average pigment particle size is preferably between 0.050 and 1 μm, more preferably between 0.070 and 0.300 μm and particularly preferably between 0.080 and 0.200 μm. Most preferably, the numeric average pigment particle size is no larger than 0.200 μm. An average particle size smaller than 0.050 μm is less desirable for decreased fastness, but mainly also because very small pigment particles or individual pigment molecules thereof may still migrate into the food packaging applications. The average particle size of pigment particles is determined with a Brookhaven Instruments Particle Sizer BI90plus based upon the principle of dynamic light scattering. The ink is diluted with ethyl acetate to a pigment concentration of 0.002 wt %. The measurement settings of the BI90plus are: 5 runs at 23° C., angle of 90°, wavelength of 635 nm and graphics=correction function However for white pigment inkjet inks, the numeric average particle diameter of the white pigment is preferably from 50 to 500 nm, more preferably from 150 to 400 nm, and most preferably from 200 to 350 nm. Sufficient hiding power cannot be obtained when the average diameter is less than 50 nm, and the storage ability and the jet-out suitability of the ink tend to be degraded when the average diameter exceeds 500 nm. The determination of the numeric average particle diameter is best performed by photon correlation spectroscopy at a wavelength of 633 nm with a 4 mW HeNe laser on a diluted sample of the pigmented inkjet ink. A suitable particle size analyzer used was a Malvern™ nano-S available from Goffin-Meyvis. A sample can, for example, be prepared by addition of one drop of ink to a cuvette containing 1.5 mL ethyl acetate and mixed until a homogenous sample was obtained. The measured particle size is the average value of 3 consecutive measurements consisting of 6 runs of 20 seconds.

Suitable white pigments are given by Table 2 in [0116] of WO 2008/074548 (AGFA). The white pigment is preferably a pigment with a refractive index greater than 1.60. The white pigments may be employed singly or in combination. Preferably titanium dioxide is used as pigment with a refractive index greater than 1.60. Preferred titanium dioxide pigments are those disclosed in [0117] and in [0118] of WO 2008/074548 (AGFA).

The pigments are preferably present in the range of 0.01 to 15%, more preferably in the range of 0.05 to 10% by weight and most preferably in the range of 0.1 to 8% by weight, each based on the total weight of the pigment dispersion. For white pigment dispersions, the white pigment is preferably present in an amount of 3% to 40% by weight of the pigment dispersion, and more preferably 5% to 35%. An amount of less than 3% by weight cannot achieve sufficient covering power and usually exhibits very poor storage stability and ejection property.

The radiation curable inkjet ink may be part of an inkjet ink set. The inkjet ink set preferably comprises at least one yellow curable ink (Y), at least one cyan curable ink (C) and at least one magenta curable ink (M) and preferably also at least one black curable ink (K). The curable CMYK-ink set may also be extended with extra inks such as red, green, blue, and/or orange to further enlarge the colour gamut of the image. The CMYK-ink set may also be extended by the combination of the full density inkjet inks with light density inkjet inks. The combination of dark and light colour inks and/or black and grey inks improves the image quality by a lowered graininess.

Polymeric Dispersants

The radiation curable inkjet ink preferably contains a dispersant, more preferably a polymeric dispersant, for dispersing the pigment. The pigmented radiation curable inkjet ink may contain a dispersion synergist to improve the dispersion quality and stability of the ink. A mixture of dispersion synergists may be used to further improve dispersion stability.

Suitable polymeric dispersants are copolymers of two monomers but they may contain three, four, five or even more monomers. The properties of polymeric dispersants depend on both the nature of the monomers and their distribution in the polymer. Copolymeric dispersants preferably have the following polymer compositions:

statistically polymerized monomers (e.g. monomers A and B polymerized into ABBAABAB);

alternating polymerized monomers (e.g. monomers A and B polymerized into ABABABAB);

gradient (tapered) polymerized monomers (e.g. monomers A and B polymerized into AAABAABBABBB);

block copolymers (e.g. monomers A and B polymerized into AAAAABBBBBB) wherein the block length of each of the blocks (2, 3, 4, 5 or even more) is important for the dispersion capability of the polymeric dispersant;

graft copolymers (graft copolymers consist of a polymeric backbone with polymeric side chains attached to the backbone); and mixed forms of these polymers, e.g. blocky gradient copolymers.

Suitable polymeric dispersants are listed in the section on "Dispersants", more specifically [0064] to [0070] and [0074] to [0077], in EP 1911814 A (AGFA).

The polymeric dispersant has preferably a number average molecular weight Mn between 500 and 30000, more preferably between 1500 and 10000.

The polymeric dispersant has preferably a weight average molecular weight Mw smaller than 100,000, more preferably smaller than 50,000 and most preferably smaller than 30,000.

The polymeric dispersant has preferably a polydispersity PD smaller than 2, more preferably smaller than 1.75 and most preferably smaller than 1.5.

Commercial examples of polymeric dispersants are the following:

DISPERBYK™ dispersants available from BYK CHEMIE GMBH;

SOLSPERSE™ dispersants available from NOVEON;

TEGOT™ DISPERS™ dispersants from EVONIK;

EDAPLAN™ dispersants from MÜNZING CHEMIE;

ETHACRYL™ dispersants from LYONDELL;

GANEX™ dispersants from ISP;

DISPEX™ and EFKA™ dispersants from CIBA SPECIALTY CHEMICALS INC;

DISPONER™ dispersants from DEUCHEM; and

JONCRYL™ dispersants from JOHNSON POLYMER.

Particularly preferred polymeric dispersants include Solsperse™ dispersants from NOVEON, Efka™ dispersants from CIBA SPECIALTY CHEMICALS INC and Disperbyk™ dispersants from BYK CHEMIE GMBH. Particularly preferred dispersants are Solsperse™ 32000, 35000 and 39000 dispersants from NOVEON. The polymeric dispersant is preferably used in an amount of 2 to 600 wt %, more preferably 5 to 200 wt %, most preferably 50 to 90 wt % based on the weight of the pigment.

Photoinitiators and Co-Initiators

The radiation curable inkjet ink and varnish preferably also contains an initiator. The initiator typically initiates the polymerization reaction. The initiator can be a thermal initiator, but is preferably a photoinitiator. The photoinitiator requires less energy to activate than the monomers, oligomers and/or prepolymers to form a polymer.

A photoyellowing photoinitiator may be used in the varnish to obtain an antique look of a print, however preferably a photoinitiator having no or only minor photoyellowing is used in varnish and inkjet inks.

The photoinitiator in the curable inkjet ink or varnish is preferably a free radical initiator, more specifically a Norrish type I initiator or a Norrish type II initiator. A free radical photoinitiator is a chemical compound that initiates polymerization of monomers and oligomers when exposed to actinic radiation by the formation of a free radical. A Norrish Type I initiator is an initiator which cleaves after excitation, yielding the initiating radical immediately. A Norrish type II-initiator is a photoinitiator which is activated by actinic radiation and forms free radicals by hydrogen abstraction from a second compound that becomes the actual initiating free radical. This second compound is called a polymerization synergist or co-initiator. Both type I and type II photoinitiators can be used in the present invention, alone or in combination.

Suitable photoinitiators are disclosed in CRIVELLO, J. V., et al. VOLUME III: Photoinitiators for Free Radical Cationic. 2nd edition. Edited by BRADLEY, G. London, UK: John Wiley and Sons Ltd, 1998. p. 287-294.

Specific examples of photoinitiators may include, but are not limited to, the following compounds or combinations thereof: benzophenone and substituted benzophenones, 1-hydroxycyclohexyl phenyl ketone, thioxanthones such as isopropylthioxanthone, 2-hydroxy-2-methyl-1-phenylpropan-1-one, 2-benzyl-2-dimethylamino-(4-morpholinophenyl) butan-1-one, benzil dimethylketal, bis(2,6-dimethylbenzoyl)-2,4,4-trimethylpentylphosphine oxide, 2,4,6-trimethylbenzoyldiphenylphosphine oxide, 2-methyl-1-[4-(methylthio)phenyl]-2-morpholinopropan-1-one, 2,2-dimethoxy-1,2-diphenylethan-1-one or 5,7-diiodo-3-butoxy-6-fluorone.

Suitable commercial photoinitiators include Irgacure™ 184, Irgacure™ 500, Irgacure™ 369, Irgacure™ 1700, Irgacure™ 651, Irgacure™ 819, Irgacure™ 1000, Irgacure™ 1300, Irgacure™ 1870, Darocur™ 1173, Darocur™ 2959, Darocur™ 4265 and Darocur™ ITX available from CIBA SPECIALTY CHEMICALS, Lucerin™ TPO available from BASF AG, Esacure™ KT046, Esacure™ KIP150, Esacure™ KT37 and Esacure™ EDB available from LAMBERTI, H-Nu™ 470 and H-Nu™ 470X available from SPECTRA GROUP Ltd.

For a low migration radiation curable inkjet ink or varnish, the photoinitiator is preferably a so-called diffusion hindered photoinitiator. A diffusion hindered photoinitiator is a photoinitiator which exhibits a much lower mobility in a cured layer of the ink or varnish than a monofunctional photoinitiator, such as benzophenone. Several methods can be used to lower the mobility of the photoinitiator. One way is to increase the molecular weight of the photoinitiators so that the diffusion speed is reduced, e.g. polymeric photoinitiators. Another way is to increase its reactivity so that it is built into the polymerizing network, e.g. multifunctional photoinitiators (having 2, 3 or more photoinitiating groups) and polymerizable photoinitiators.

The diffusion hindered photoinitiator is preferably selected from the group consisting of non-polymeric multifunctional photoinitiators, oligomeric or polymeric photoinitiators and polymerizable photoinitiators. Non-polymeric di- or multifunctional photoinitiators are considered to have a molecular weight between 300 and 900 Dalton. Non-polymerizable monofunctional photoinitiators with a molecular weight in that range are not diffusion hindered photoinitiators. Most preferably the diffusion hindered photoinitiator is a polymerizable initiator or a polymeric photoinitiator.

A preferred diffusion hindered photoinitiator contains one or more photoinitiating functional groups derived from a Norrish type I-photoinitiator selected from the group consisting of benzoinethers, benzil ketals, α,α-dialkoxyacetophenones, α-hydroxyalkylphenones, α-aminoalkylphenones, acylphosphine oxides, acylphosphine sulphides, α-haloketones, α-halosulfones and phenylglyoxalates.

A preferred diffusion hindered photoinitiator contains one or more photoinitiating functional groups derived from a Norrish type II-initiator selected from the group consisting of benzophenones, thioxanthones, 1,2-diketones and anthraquinones.

Suitable diffusion hindered photoinitiators are also those disclosed in EP 2065362 A (AGFA) in paragraphs [0074] and for difunctional and multifunctional photoinitiators, in paragraphs [0077] to [0080] for polymeric photoinitiators and in paragraphs [0081] to [0083] for polymerizable photoinitiators.

Other preferred polymerizable photoinitiators are those disclosed in EP 2161264 A (AGFA). A preferred amount of photoinitiator is 0-50 wt %, more preferably 0.1-20 wt %, and most preferably 0.3-15 wt % of the total weight of the radiation curable ink or varnish.

In a very preferred embodiment, the radiation curable inkjet ink includes a polymerizable or polymeric thioxanthone photoinitiator and an acylphosphine oxide-based polymerization photoinitiator, more preferably a bis(2,4,6-trimethylbenzoyl)-phenylphosphineoxide photoinitiator.

Photoinitiators like bis(2,4,6-trimethylbenzoyl)-phenylphosphineoxide photoinitiator are monofunctional but are allowed by the Swiss ordinance SR 817.023.21 on Objects and Materials due to their very low toxicity level.

In order to increase the photosensitivity further, the radiation curable ink or varnish may additionally contain co-initiators. Suitable examples of co-initiators can be categorized in three groups: 1) tertiary aliphatic amines such as methyldiethanolamine, dimethylethanolamine, triethanolamine, triethylamine and N-methylmorpholine; (2) aromatic amines such as amylparadimethylaminobenzoate, 2-n-butoxyethyl-4-(dimethylamino)benzoate, 2-(dimethylamino)ethylbenzoate, ethyl-4-(dimethylamino)benzoate, and 2-ethylhexyl-4-(dimethylamino)benzoate; and (3) (meth)acrylated amines such as dialkylamino alkyl(meth)acrylates (e.g., diethylaminoethylacrylate) or N-morpholinoalkyl-(meth)acrylates (e.g., N-morpholinoethyl-acrylate).

The preferred co-initiators are aminobenzoates.

When one or more co-initiators are included into the radiation curable inkjet ink or varnish, preferably these co-initiators are diffusion hindered for safety reasons.

A diffusion hindered co-initiator is preferably selected from the group consisting of non-polymeric di- or multifunctional co-initiators, oligomeric or polymeric co-initiators and polymerizable co-initiators. More preferably the diffusion hindered co-initiator is selected from the group consisting of polymeric co-initiators and polymerizable co-initiators. Most preferably the diffusion hindered co-initiator is a polymerizable co-initiator having at least one (meth)acrylate group, more preferably having at least one acrylate group.

The radiation curable inkjet ink preferably includes a polymerizable or polymeric tertiary amine co-initiator.

Preferred diffusion hindered co-initiators are the polymerizable co-initiators disclosed in EP 2053101 A (AGFA) in paragraphs [0088] and [0097].

Preferred diffusion hindered co-initiators include a polymeric co-initiator having a dendritic polymeric architecture, more preferably a hyperbranched polymeric architecture. Preferred hyperbranched polymeric co-initiators are those disclosed in US 2006014848 (AGFA).

The radiation curable inkjet ink or varnish preferably includes the diffusion hindered co-initiator in an amount of 0.1 to 50 wt %, more preferably in an amount of 0.5 to 25 wt %, most preferably in an amount of 1 to 10 wt % of the total weight of the inkjet ink or varnish.

Polymerization Inhibitors

The radiation curable varnish and inkjet inks may contain a polymerization inhibitor. Suitable polymerization inhibitors include phenol type antioxidants, hindered amine light stabilizers, phosphor type antioxidants, hydroquinone monomethyl ether commonly used in (meth)acrylate monomers, and hydroquinone, t-butylcatechol, pyrogallol may also be used.

Suitable commercial inhibitors are, for example, Sumilizer™ GA-80, Sumilizer™ GM and Sumilizer™ GS produced by Sumitomo Chemical Co. Ltd.; Genorad™ 16, Genorad™ 18 and Genorad™ 20 from Rahn AG; Irgastab™ UV10 and Irgastab™ UV22, Tinuvin™ 460 and CGS20 from Ciba Specialty Chemicals; Floorstab™ UV range (UV-1, UV-2, UV-5 and UV-8) from Kromachem Ltd, Additol™ S range (S100, S110, S120 and S130) from Cytec Surface Specialties.

Since excessive addition of these polymerization inhibitors will lower the ink sensitivity to curing, it is preferred that the amount capable of preventing polymerization is determined prior to blending. The amount of a polymerization inhibitor is preferably lower than 2 wt % of the total weight of the varnish or inkjet ink.

Surfactants

The varnish and radiation curable inkjet inks may contain at least one surfactant. The surfactant can be anionic, cationic, non-ionic, or zwitter-ionic and is usually added in a total quantity less than 3 wt % based on the total weight of the ink and particularly in a total less than 1 wt % based on the total weight of the varnish or inkjet ink.

Suitable surfactants include fluorinated surfactants, fatty acid salts, ester salts of a higher alcohol, alkylbenzene sulfonate salts, sulfosuccinate ester salts and phosphate ester salts of a higher alcohol (for example, sodium dodecylbenzenesulfonate and sodium dioctylsulfosuccinate), ethylene oxide adducts of a higher alcohol, ethylene oxide adducts of an alkylphenol, ethylene oxide adducts of a polyhydric alcohol fatty acid ester, and acetylene glycol and ethylene oxide adducts thereof (for example, polyoxyethylene nonylphenyl ether, and SURFYNOL™ 104, 104H, 440, 465 and TG available from AIR PRODUCTS & CHEMICALS INC.).

Preferred surfactants are selected from fluoro surfactants (such as fluorinated hydrocarbons) and silicone surfactants. The silicone surfactants are preferably siloxanes and can be alkoxylated, polyether modified, polyether modified hydroxy functional, amine modified, epoxy modified and other modifications or combinations thereof. Preferred siloxanes are polymeric, for example polydimethylsiloxanes.

Preferred commercial silicone surfactants include BYK™ 333 and BYK™ UV3510 from BYK Chemie.

In a preferred embodiment, the surfactant is a polymerizable compound.

Preferred polymerizable silicone surfactants include a (meth)acrylated silicone surfactant. Most preferably the (meth)acrylated silicone surfactant is an acrylated silicone surfactant, because acrylates are more reactive than methacrylates.

In a preferred embodiment, the (meth)acrylated silicone surfactant is a polyether modified (meth)acrylated polydimethylsiloxane or a polyester modified (meth)acrylated polydimethylsiloxane.

Preferred commercially available (meth)acrylated silicone surfactants include: Ebecryl™ 350, a silicone diacrylate from Cytec; the polyether modified acrylated polydimethylsiloxane BYK™ UV3500 and BYK™ UV3530, the polyester modified acrylated polydimethylsiloxane BYK™ UV3570, all manufactured by BYK Chemie; Tego™ Rad 2100, Tego™ Rad 2200N, Tego™ Rad 2250N, Tego™ Rad 2300, Tego™ Rad 2500, Tego™ Rad 2600, and Tego™ Rad 2700, Tego™ RC711 from EVONIK; Silaplane™ FM7711, Silaplane™ FM7721, Silaplane™ FM7731, Silaplane™ FM0711, Silaplane™ FM0721, Silaplane™ FM0725, Silaplane™ TM0701, Silaplane™ TM0701T all manufactured by Chisso Corporation; and DMS-R05, DMS-R11, DMS-R18, DMS-R22, DMS-R31, DMS-U21, DBE-U22, SIB1400, RMS-044, RMS-033, RMS-083, UMS-182, UMS-992, UCS-052, RTT-1011 and UTT-1012 all manufactured by Gelest, Inc.

Preparation of Inkjet Inks

Pigment dispersions may be prepared by precipitating or milling the pigment in the dispersion medium in the presence of the dispersant.

Mixing apparatuses may include a pressure kneader, an open kneader, a planetary mixer, a dissolver, and a Dalton Universal Mixer. Suitable milling and dispersion apparatuses are a ball mill, a pearl mill, a colloid mill, a high-speed disperser, double rollers, a bead mill, a paint conditioner, and triple rollers. The dispersions may also be prepared using ultrasonic energy.

Many different types of materials may be used as milling media, such as glasses, ceramics, metals, and plastics. In a preferred embodiment, the grinding media can comprise particles, preferably substantially spherical in shape, e.g. beads consisting essentially of a polymeric resin or yttrium stabilized zirconium beads.

In the process of mixing, milling and dispersion, each process is performed with cooling to prevent build up of heat, and as much as possible under light conditions in which actinic radiation has been substantially excluded.

The pigment dispersion may contain more than one pigment, the pigment dispersion or ink may be prepared using separate dispersions for each pigment, or alternatively several pigments may be mixed and co-milled in preparing the dispersion.

The dispersion process can be carried out in a continuous, batch or semi-batch mode.

The preferred amounts and ratios of the ingredients of the mill grind will vary widely depending upon the specific materials and the intended applications. The contents of the milling mixture comprise the mill grind and the milling media. The mill grind comprises pigment, polymeric dispersant and a liquid carrier. For inkjet inks, the pigment is usually present in the mill grind at 1 to 50 wt %, excluding the milling media. The weight ratio of pigment over polymeric dispersant is 20:1 to 1:2.

The milling time can vary widely and depends upon the pigment, the selected mechanical devices and residence conditions, the initial and desired final particle size, etc. In a preferred embodiment of the present invention pigment dispersions with an average particle size of less than 100 nm may be prepared.

After milling is completed, the milling media is separated from the milled particulate product (in either a dry or liquid dispersion form) using conventional separation techniques, such as by filtration, sieving through a mesh screen, and the like. Often the sieve is built into the mill, e.g. for a bead mill. The milled pigment concentrate is preferably separated from the milling media by filtration.

In general it is desirable to make inkjet inks in the form of a concentrated mill grind, which is subsequently diluted to the appropriate concentration for use in the inkjet printing system. This technique permits preparation of a greater quantity of pigmented ink from the equipment. By dilution, the inkjet ink is adjusted to the desired viscosity, surface tension, colour, hue, saturation density, and print area coverage for the particular application.

Inkjet Printers

In a preferred embodiment of the present invention, the varnish may be applied to an ink-receiver by a single pass inkjet printer, or by a multi-pass inkjet printer. Single pass inkjet printers will be discussed in more detail. The concept and construction of single pass inkjet printers are well known to the person skilled in the art. An example of such a single pass inkjet printer is: Dotrix Modular from Agfa Graphics. A single pass inkjet printer for printing UV curable ink onto an ink-receiver typically contains one or more inkjet print heads, a device to transport the ink receiver beneath the print head(s), some curing devices (UV or e-beam) and electronics to control the printing procedure.

The single pass inkjet printer is preferably at least capable of printing cyan (C), magenta (M), yellow (Y) and black (K) inkjet inks. In a preferred embodiment, the CMYK inkjet ink set used in the single pass inkjet printer may also be extended with extra inks such as red, green, blue, orange and/or violet to further enlarge the colour gamut of the image. White ink may also be used, e.g. to increase the opacity of the ink-receiver. The CMYK ink set may also be extended by the combination of full density and light density inks of colour inks and/or black inks to improve the image quality by lowered graininess.

Inkjet Print Heads

The radiation curable inks may be jetted by one or more printing heads ejecting small droplets of ink in a controlled manner through nozzles onto an ink-receiving surface, which is moving relative to the printing head(s).

A preferred print head for the inkjet printing system is a piezoelectric head. Piezoelectric inkjet printing is based on the movement of a piezoelectric ceramic transducer when a voltage is applied thereto. The application of a voltage changes the shape of the piezoelectric ceramic transducer in the print head creating a void, which is then filled with ink. When the voltage is again removed, the ceramic expands to its original shape, ejecting a drop of ink from the print head. Other inkjet printing heads can be used and include various types, such as a continuous type and thermal, electrostatic and acoustic drop on demand type.

At high printing speeds, the inks must be ejected readily from the printing heads, which puts a number of constraints on the physical properties of the ink, e.g. a low viscosity at the jetting temperature, which may vary from 25° C. to 110° C., a surface energy such that the print head nozzle can form the necessary small droplets, a homogenous ink capable of rapid conversion to a dry printed area, etc.

In so-called multi-pass inkjet printers, the inkjet print head scans back and forth in a transversal direction across the moving ink-receiver surface, but in a "single pass printing process", the printing is accomplished by using page wide inkjet printing heads or multiple staggered inkjet printing heads which cover the entire width of the ink-receiver surface. In a single pass printing process the inkjet printing heads preferably remain stationary while the ink-receiver surface is transported under the inkjet printing head(s). All curable inks have then to be cured downstream of the printing area by a radiation curing devices.

By avoiding the transversal scanning of the print head, high printing speeds can be obtained. In embodiments in accordance with the present invention, if single pass inkjet printing is used, the printing speed is preferably at least 35 m/min, more preferably at least 50 m/min. Further, the resolution may be 180 dpi or more, e.g. 300 dpi or more. The ink-receiver may have a width of 240 mm or more.

Curing Devices

A suitable single pass inkjet printer that may be used in embodiments of a method in accordance with the present invention preferably contains the necessary curing devices for providing a partial and a final curing treatment. Radiation curable inks can be cured by exposing them to actinic radiation. These curable inks preferably comprise a photoinitiator which allows radiation curing, preferably by ultraviolet radiation.

In a preferred embodiment a static fixed radiation source is employed. The source of radiation arranged is preferably an elongated radiation source extending transversely across the ink-receiver surface to be cured and positioned down stream from the inkjet print head.

Many light sources exist in UV radiation, including a high or low pressure mercury lamp, a cold cathode tube, a black light, an ultraviolet LED, an ultraviolet laser, and a flash light. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing.

UV radiation is generally classed as UV-A, UV-B, and UV-C as follows:

UV-A: 320 nm to 400 nm

UV-B: 290 nm to 320 nm

UV-C: 100 nm to 290 nm.

Furthermore, it is possible to cure the image using two different light sources differing in wavelength or illuminance. For example, the first UV-source for partial curing can be selected to be rich in UV-A, e.g. an iron-doped lamp, and the UV-source for final curing can then be rich in UV-C, e.g. a non-doped lamp.

In embodiments, the radiation curable inkjet inks may receive a final curing treatment by e-beam or by a mercury lamp. The partial curing may be performed by UV LEDs.

The terms "partial cure", "pin cure", and "full cure" refer to the degree of curing, i.e, the percentage of converted functional groups, and may be determined by for example RT-FTIR (Real-Time Fourier Transform Infra-Red Spectroscopy) a method well known to the one skilled in the art of curable formulations. A partial cure, also called a pin cure, is defined as a degree of curing wherein at least 5%, preferably at least 10%, of the functional groups in the coated formulation is converted. A full cure is defined as a degree of curing wherein the increase in the percentage of converted functional groups, with increased exposure to radiation (time and/or dose), is negligible. A full cure corresponds with a conversion percentage that is within 10%, preferably within 5%, from the maximum conversion percentage defined by the horizontal asymptote in the RT-FTIR graph (percentage conversion versus curing energy or curing time).

For facilitating curing, the inkjet printer preferably includes one or more oxygen depletion units. A preferred oxygen depletion unit places a blanket of nitrogen or other relatively inert gas (e.g. $CO_2$) with adjustable position and adjustable inert gas concentration, in order to reduce the oxygen concentration in the curing environment. Residual oxygen levels are usually maintained as low as 200 ppm, but are generally in the range of 200 ppm to 1200 ppm.

Random Patterning

The rendering of an image is preferably done by an image manipulation unit, e.g. a raster image processor, which includes a digital half-toning module. In a digital half-toning module a continuous-tone input image with an amount of channels, corresponding to the printer colourants (such as CMYK), wherein each channel possesses a full range of tones from white through greys to black, ranging from 0% to 100%, is converted to an output image, with the same amount of channels, wherein each channel has output pixels. Only a limited number of grey levels for the output pixels are possible. In binary digital half-toning the levels of the output pixels is either black or white. In multilevel digital half-toning the amount of levels of the output pixels is at least three. The pixels may be white, black, or can have intermediate grey values. The amount of levels of the output pixels corresponds to the amount of droplets that is available by the print head that is used to output the image. A digital half-toning technique converts the multiple density values of the input pixels of a continuous tone input image into a geometric distribution of binary or multilevel halftone dots that can be printed by the reproduction device. Each halftone dot is reproduced as a microdot or as a clustered set of microdots. A microdot is the smallest element that can be written by a reproduction device. When the halftone dots are small enough, the eye is not capable of seeing the individual halftone dots, and only sees the corresponding spatially integrated density value of the geometric distribution. The two main classes of half-toning techniques that are used are known as "amplitude modulation screening" (abbreviated as AM screening) and "frequency modulation screening" (abbreviated as FM screening). According to amplitude modulation screening, the halftone dots, that together give the impression of a particular tone, are arranged on a fixed geometric grid. By varying the size of the halftone dots, the different tones of an image can be simulated. According to frequency modulation screening, the distance between the fixed sized halftone dots is modulated to render different tone values. Frequency modulation is sometimes called "stochastic screening", because most FM screening algorithms produce half-tone dot patterns that are stochastic (non-deterministic) in nature. More in-depth general knowledge can be found in EP 1 401 190 A.

To convert the channel for the varnish in the continuous-tone input image to the output image, the digital half-toning technique that is used may be a random digital half-toning technique, preferably a white noise digital half-toning technique, or more preferably a blue noise digital half-toning technique; other digital half-toning techniques such as an error-diffusion algorithm may be used as well.

EXAMPLES

Materials

All materials used in the following examples were readily available from standard sources such as Aldrich Chemical Co. (Belgium) and Acros (Belgium) unless otherwise specified.

VEEA is 2-(vinylethoxy)ethyl acrylate available from NIPPON SHOKUBAI, Japan.

ETMPTA is ethoxylated(15) trimethylolpropane acrylate available as Sartomer™ SR9035 from SARTOMER.

TMPTA is trimethylolpropane triacrylate available as Sartomer™ SR351 from SARTOMER.

TPO is 2,4,6-trimethylbenzoyl-diphenyl-phosphineoxide available as Genocure™ TPO from RAHN AG.

TPO-L is 2,4,6-trimethylbenzoyl phenyl phosphinic acid ethylester available as Lucirin™ TPO-L from BASF.

Irgacure™ 379 is 2-(dimethyl amino)-2-[(4-methyl phenyl)methyl]-1-[4-(4-morpholinyl)phenyl]-1-butanone available from BASF.

Irgastab™ UV 10 is 4-hydroxy-2,2,6,6-tetramethylpiperidinooxy sebacate available from BASF.

BYK™ UV3510 is a polyethermodified polydimethylsiloxane surfactant available from BYK Chemie GmbH.

Varnish-1 is a colourless varnish prepared by mixing the components according to Table 1 and which had a viscosity of 6.3 mPa·s. The weight percentage wt % indicated is based on the total weight of the varnish.

TABLE 1

| Component | wt % |
|---|---|
| VEEA | 68.55 |
| ETMPTA | 15.00 |
| TMPTA | 5.00 |
| TPO | 4.95 |
| TPO-L | 5.00 |
| Irgacure ™ 379 | 0.30 |
| Irgastab ™ UV10 | 0.20 |
| Byk ™ UV3510 | 1.00 |

Varnish-2 is a yellowish varnish for which the transparant Agora™ G1 yellow ink available from Agfa Graphics NV and which had a viscosity of 5.5 mPa·s at 45° C. and at a shear rate of 30 $s^{-1}$ was used.

The radiation curable inkjet colour inks used in the tests were the CMYK inkjet ink set Agora™ G1 available from Agfa Graphics NV.

As ink-receiver materials, HiFi and G-Print were used.

HiFi is a substantially non-absorbing polyester film available as HiFi™ PMX749 from HiFi Industrial Film (UK), which has a surface energy of 37 $mJ/m^2$.

G-Print is a wood-free coated paper from Arctic Paper.

Inkjet Printer

A custom built single pass inkjet printer was used, very similar to the one shown in FIG. 3 of patent application EP12157840.5 filed on 2012 Mar. 2.

The used single pass inkjet printer had four inkjet print heads (not eight as the one shown in FIG. 3 of the cited patent application), and each of these four inkjet print heads was followed by a UV LED curing station for pin curing. A final curing station was positioned after the fourth UV LED curing station, so that ink jetted on an ink-receiver by the first inkjet print head was cured by the first UV LED curing station, subsequently by the second, third and fourth UV LED curing stations, and finally by the final curing station.

The used single pass inkjet printer had an undercarriage on which a linear motor was mounted. The sled of the linear motor was attached to a substrate table. Ink-receivers are held in place on the substrate table by a vacuum suction system. A bridge was built on the undercarriage perpendicular to the direction of the linear motor. Connected to the bridge a cage for the print heads was mounted. This cage was provided with the necessary mechanical adjustment means to align the print heads such that they could one by one print the same surface on the substrate table moving beneath them in a single pass.

The print heads could be used for grey scale inkjet printing and for binary inkjet printing. For the grey scale inkjet printing, four different ink drops were used: 2.7 pL, 3.5 pL, 7 pL and 11 pL (wherein the symbol pL means picoliter). In some embodiments, as indicated in the examples, binary inkjet printing, using a single drop size, was used. Kyocera KJ4A printheads having nozzles with a nozzle diameter of less than 25 μm were used, that were able to jet these drop sizes.

The image resolution was 600×600 dpi.

The ink-receiver was moved with respect to the print heads by the linear motor. The print heads jetted ink on the ink-receiver, in the order KCM varnish, i.e. first black ink was jetted by the first print head, then cyan ink by the second and magenta ink by the third print head, and finally varnish was jetted by the fourth print head; however, the varnish was jetted, and cured, in a second step while the KCM inks were jetted in a first step, as explained in detail further below.

The linear motor and the inkjet print heads were controlled by a specific program and separate electronic circuits. The synchronization between the linear motor and the inkjet print heads was possible because the encoder pulses of the linear motor were also fed to the electronic circuits that controlled the inkjet print heads. The firing pulses of the inkjet print heads were supplied synchronously with the encoder pulses of the linear motor and thus in this manner the movement of the substrate table was synchronized with the inkjet print head. The software driving the print heads could translate any CMYK encoded image into control signals for the print heads.

Each print head had its own ink supply. The main circuit was a closed loop, wherein circulation was provided by a pump. This circuit started from a header tank, mounted in the immediate vicinity of the inkjet print head, to a degassing membrane and then through a filter and the pump back to the header tank. The membrane was impervious to ink but permeable to air. By applying a strong underpressure on one side of the membrane, air was drawn from the ink located on the other side of the membrane.

The function of the header tank is threefold. The header tank contains a quantity of permanently degassed ink that can be delivered to the inkjet print head. Secondly, a small underpressure was exerted in the header tank to prevent ink leakage from the print head and to form a meniscus in the ink jet nozzle. The third function was that by a float in the header tank the ink level in the circuit could be monitored.

Furthermore, two short channels were connected to the closed loop: one input channel and one output channel. On a signal from the float in the header tank, a quantity of ink from an ink storage container was brought via the input channel into the closed circuit just before the degassing membrane. The short output channel ran from the header tank to the inkjet print head, where the ink was consumed, i.e. jetted on the ink receiver.

The UV LED curing stations were water cooled UV LED modules from Integration Technology, emitting UV light with peak intensity at 395 nm. The final curing station contained two mercury vapor lamps, which were one iron doped mercury lamp and one non-doped mercury lamp. The UV LED curing stations and the mercury vapor lamps were individually adjustable in terms of guidance and outputted power UV light.

In all examples below, unless stated otherwise, the following conditions were used.

In a first step, an image was printed, and in a second step a varnish was jetted on the image. The image was a "step wedges image", namely a rectangular matrix of smaller rectangles forming a plurality of step wedges, wherein each of the step wedges had a number of rectangles printed at increasing ink coverage. All step wedges had the same number of rectangles, that were printed at the same set of increasing ink coverage. The difference between the step wedges was that they were printed at a different varnish coverages: each wedge was printed at a specific varnish coverage, so that a rectangular matrix of ink coverages versus varnish coverages was obtained. For the step wedges image, magenta (M), black (K) and cyan (C) Agora™ G1 inks were used (no yellow (Y), and this as follows: for a coverage of 100% and less, only magenta ink was used, for a coverage above 100%, magenta and black inks were used (100% M and 100% K for a coverage of 200%), and for a coverage above 200%, magenta, black and cyan inks were used. The varnish was jetted respectively at a coverage of 0% (i.e. no varnish), at 10% coverage, at 20%, and so on, in increments of 10%, up to 100% (i.e. full varnish coverage). For the coverages of 10% up to, and including, 90%, the varnish was jetted in a random pattern (white noise).

In the single pass inkjet printer, the inks making up the step wedges image were jetted as follows, in the first step mentioned above. Initially (if present in the image), the black ink was jetted, followed by curing in the first UV LED curing station (this station also operated if no black ink was present in the image), then the cyan ink was jetted (again, if present in the image), followed by curing in the second UV LED curing station (again, always operating), then the magenta ink was jetted (again, if present in the image), followed by curing in the third UV LED curing station (again, always operating). This was followed by curing in the fourth UV LED curing station and by final curing by the final curing station. After the image was thus printed in the first step, in the second step the varnish was jetted, followed by curing in the fourth UV LED curing station, and then followed by final curing by the final curing station.

The moving speed of the ink-receiver with respect to the print heads was 50 m/min. The time lapse between jetting the K and the C inks was 276 ms, which was also the time lapse between the jetting of the C and the M inks. The time lapse between the jetting of an ink (K, or C, or M) and the subsequent curing in a UV LED curing station was 138 ms. The time lapse between the curing in the third UV LED curing station following the jetting of the magenta ink, and the curing in the fourth UV LED curing station, was 276 ms, and the time lapse between the curing in the fourth UV LED curing station and the final curing in the final curing station was 762 ms. The time lapse between the jetting of the varnish and the curing in the fourth UV LED curing station was 138 ms. The time lapse between the curing in this UV LED curing station and the final curing in the final curing station was 762 ms. If no ink of a particular colour was jetted (what ink colours were used for a specific rectangle in the step wedges image depends on the ink coverage of the specific rectangle, as discussed above), the time lapses mentioned above remained the same, but designated, instead of the moment that the ink was jetted, the moment that the ink-receiver and the print head were in the position with respect to each other for jetting the ink of the particular colour.

The curing energy (in mJ/m$^2$), as measured with an EIT PowerPuck II, was as follows for the printing of the image. The UV LED curing stations operated at a cumulative energy of 40 mJ/m$^2$ UV-A2 EIT (370 nm-415 nm). The curing energy of the final curing was 272 mJ/m$^2$ UV-A EIT (320 nm-390 nm), 105 mJ/m$^2$ UV-B EIT (280 nm-320 nm), 20 mJ/m$^2$ UV-C EIT (245 nm-265 nm), and 107 mJ/m$^2$ UV-V EIT (385 nm-440 nm).

For the "normal" curing level of the varnish, the curing energy (in mJ/m$^2$), as measured with an EIT PowerPuck II, was as follows. The fourth UV LED curing station, for the varnish, operated at an energy of 11 mJ/m$^2$ UV-A2 EIT (370 nm-415 nm). The curing energy of the final curing was 272 mJ/m$^2$ UV-A EIT (320 nm-390 nm), 105 mJ/m$^2$ UV-B EIT (280 nm-320 nm), 20 mJ/m$^2$ UV-C EIT (245 nm-265 nm), and 107 mJ/m$^2$UV-V EIT (385 nm-440 nm).

For the "HighCure" curing level of the varnish, the curing energy (in mJ/m$^2$), as measured with an EIT PowerPuck II, was as follows. The fourth UV LED curing station, for the varnish, operated at an energy of 29 mJ/m$^2$ UV-A2 EIT (370 nm-415 nm). The curing energy of the final curing was 317 mJ/m$^2$ UV-A EIT (320 nm-390 nm), 141 mJ/m$^2$ UV-B EIT (280 nm-320 nm), 29 mJ/m$^2$ UV-C EIT (245 nm-265 nm), and 127 mJ/m$^2$UV-V EIT (385 nm-440 nm).

For the "ExtraHighCure" curing level of the varnish, the curing energy (in mJ/m$^2$), as measured with an EIT PowerPuck II, was as follows. The fourth UV LED curing station, for the varnish, operated at an energy of 41 mJ/m$^2$ UV-A2 EIT (370 nm-415 nm). The curing energy of the final curing was 317 mJ/m$^2$ UV-A EIT (320 nm-390 nm), 141 mJ/m$^2$ UV-B EIT (280 nm-320 nm), 29 mJ/m$^2$ UV-C EIT (245 nm-265 nm), and 127 mJ/m$^2$ UV-V EIT (385 nm-440 nm).

Measurement Methods

1. Viscosity

The viscosity of the varnish was measured using a Brookfield DV-II+ viscometer at 45° C. at 12 rotations per minute (RPM) using a CPE 40 spindle. This corresponds to a shear rate of 30 s$^{-1}$.

2. Average Particle Size

The particle size of pigment particles in the yellowish varnish was determined by photon correlation spectroscopy at a wavelength of 633 nm with a 4 mW HeNe laser on a diluted sample of the varnish. The particle size analyzer used was a Malvern™ nano-S available from Goffin-Meyvis.

The sample was prepared by addition of one drop of varnish to a cuvette containing 1.5 mL ethyl acetate and mixed until a homogenous sample was obtained. The measured particle size is the average value of 3 consecutive measurements consisting of 6 runs of 20 seconds.

3. Gloss

The gloss was measured at an angle of 60° with a REFO3-D available from Dr. LANGE GmbH, Germany.

Example 1

This example illustrates how the gloss can be controlled from glossy to mat using a single varnish.

Varnish-1 was jetted on the image on a HiFi ink-receiver. The varnish was jetted using grey scale inkjet printing. For the curing of the varnish, the HighCure curing level was used. Table 2 below shows the measured gloss levels.

TABLE 2

| Varnish | Image Ink coverage | | |
|---|---|---|---|
| Coverage | 60% | 100% | 200% |
| 0% | 108.5 | 106.5 | 102.0 |
| 10% | 90.8 | 88.8 | 84.9 |
| 20% | 76.3 | 73.8 | 70.3 |
| 30% | 62.6 | 60.9 | 58.8 |
| 40% | 52.4 | 51.3 | 49.5 |
| 50% | 44.9 | 43.7 | 41.8 |
| 60% | 37.9 | 36.9 | 35.6 |
| 70% | 33.3 | 32.0 | 30.5 |
| 80% | 29.0 | 28.4 | 26.7 |
| 90% | 26.0 | 25.7 | 24.0 |
| 100% | 25.6 | 24.7 | 23.5 |

As can be seen in Table 2, the gloss can be varied from a glossy level, of e.g. about 75 for 20% varnish coverage, to a mat level, of e.g. about 25 for 100% varnish coverage.

Example 2

This example illustrates how the gloss can be controlled from glossy to mat using a single varnish while simultaneously an antique look can be attributed to a print.

Varnish-2 was jetted on the image on a G-Print ink-receiver. The varnish was jetted using grey scale inkjet printing. Moreover, the image data was used to determine the locations where the varnish was jetted: varnish was jetted, in a random pattern, on the locations where ink was previously jetted (these locations were determined from to the image data). In locations with a total ink coverage of less than 100%, diffusion dithering was applied to the random pattern that was used for jetting the varnish (Diffusion Dither in Adobe Photoshop™ was applied, which is a kind of error-diffusion process). In locations with a total ink coverage of 100% or more, the random pattern for the varnish remained unchanged. For the curing of the varnish, the normal curing level was used. Table 3 shows the measured gloss levels.

TABLE 3

| Varnish | Image Ink coverage | | |
|---|---|---|---|
| Coverage | 60% | 100% | 200% |
| 0% | 59.9 | 90.6 | 94.2 |
| 10% | 54.1 | 78.9 | 83.2 |
| 20% | 49.2 | 64.4 | 69.8 |
| 30% | 44.3 | 54.4 | 57.7 |
| 40% | 40.6 | 47.9 | 48.6 |
| 50% | 36.9 | 40.8 | 41.1 |
| 60% | 33.1 | 34.2 | 35.0 |
| 70% | 31.3 | 32.8 | 31.3 |
| 80% | 27.3 | 29.9 | 28.9 |
| 90% | 24.8 | 27.8 | 26.7 |
| 100% | 24.2 | 26.4 | 25.2 |

The gloss can again be varied in a wide range; e.g. at 20% varnish coverage a gloss level of 50 to 70 is obtained, and at 100% varnish coverage a level of about 25. The image exhibited an antique look.

Example 3

Comparing this example to Example 1 illustrates that, using a single varnish, a low gloss level, i.e. a mat appearance can be obtained on a mat ink-receiver (G-Print in this example) and on a glossy ink-receiver as well (HiFi in Example 1).

Varnish-1 was jetted on the image on a G-Print ink-receiver. The varnish was jetted using grey scale inkjet printing. For the curing of the varnish, the HighCure curing level was used. Table 4 shows that the measured gloss level for 100% varnish coverage is about 20.

TABLE 4

| Varnish | Image Ink coverage | | |
|---|---|---|---|
| Coverage | 60% | 100% | 200% |
| 0% | 59.7 | 100.8 | 99.5 |
| 10% | 51.9 | 83.8 | 82.6 |
| 20% | 41.4 | 68.0 | 67.0 |
| 30% | 35.8 | 57.2 | 57.2 |
| 40% | 29.7 | 47.9 | 47.8 |
| 50% | 26.4 | 40.9 | 40.2 |
| 60% | 23.6 | 34.8 | 34.6 |
| 70% | 20.8 | 30.2 | 29.8 |
| 80% | 19.1 | 26.8 | 26.4 |
| 90% | 17.9 | 24.3 | 23.8 |
| 100% | 16.7 | 23.0 | 21.6 |

Example 4

In this example, the varnish was jetted using binary inkjet printing. The single drop size was an extra small drop size, 2.3 pL.

Varnish-2 was jetted on the image on a G-Print ink-receiver. For the curing of the varnish, the ExtraHighCure curing level was used. Table 5 shows the measured gloss levels.

TABLE 5

| Varnish | Image Ink coverage | | |
|---|---|---|---|
| Coverage | 60% | 100% | 200% |
| 0% | 53.1 | 84.9 | 99.2 |
| 10% | 55.3 | 88.0 | 92.1 |
| 20% | 48.8 | 82.1 | 80.8 |
| 30% | 44.1 | 73.2 | 74.6 |
| 40% | 42.2 | 67.4 | 68.2 |
| 50% | 37.3 | 62.0 | 61.8 |
| 60% | 34.7 | 54.9 | 54.0 |
| 70% | 30.6 | 48.6 | 47.6 |
| 80% | 27.0 | 41.7 | 41.2 |
| 90% | 23.7 | 33.2 | 33.4 |
| 100% | 20.2 | 29.7 | 26.3 |

The image having a varnish coverage of 10% or more exhibited an antique look. The gloss can again be controlled in the desired manner. For having a uniform gloss level of about 48.0, it can be seen from Table 6 that for an image ink coverage of 60% an application of a bit more than 20% varnish coverage is required, while for an image ink coverage of 100% or 200% the varnish coverage should be about 70%.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A method for inkjet varnishing a substrate, the method comprising the steps of:

jetting a micro-pattern of a varnish having a viscosity of less than 30 mPa·s at 45° C. and at a shear rate of 30 $s^{-1}$ to a portion of the substrate using one or more print heads including nozzles having a nozzle diameter of no more than 30 μm; and at least partially curing the micro-pattern within 500 milliseconds after jetting the micro-pattern to provide a micro-roughness to the portion of the substrate.

2. The method according to claim 1, wherein the varnish includes a yellow colour pigment having an average particle size of less than 200 nm as determined by laser diffraction and/or a photoyellowing photoinitiator.

3. The method according to claim 2, wherein the photoyellowing photoinitiator is a thioxanthone photoinitiator.

4. The method according to claim 1, wherein the varnish includes at least 20 wt % of a vinylether acrylate based on a total weight of the varnish.

5. The method according to claim 1, wherein the varnish is jetted by the one or more print heads including nozzles having a nozzle diameter of no more than 22 μm.

6. The method according to claim 1, wherein the micro-pattern includes a plurality of varnish drops having a first drop size and a plurality of varnish drops having a second drop size larger than the first drop size.

7. The method according to claim 1, wherein the micro-pattern is a random pattern.

8. The method according to claim 1, wherein the micro-pattern covers 40% to 80% of the portion of the substrate.

9. The method according to claim 1, wherein the varnish contains no or less than 0.1 wt % of particulate matter based on a total weight of the varnish that has an average size larger than 10% of the nozzle diameter as measured by laser diffraction.

10. The method according to claim 1, wherein the substrate is a print of one or more radiation curable inkjet inks.

11. The method according to claim 10, further comprising the step of:

using image data in the print to determine a location on the substrate to jet the micro-pattern of the varnish.

12. The method according to claim 10, wherein the micro-pattern is jetted on a portion of the print having a highest amount of radiation curable inkjet ink per unit of surface area.

13. The method according to claim 1, wherein the micro-pattern of the varnish is fully cured in the at least partially curing step.

14. The method according to claim 1, wherein the varnish is jetted by a single pass inkjet printer.

15. A varnished substrate obtained by the method according to claim 1.

* * * * *